United States Patent [19]

Umino et al.

[11] Patent Number: 4,650,724

[45] Date of Patent: Mar. 17, 1987

[54] HIGH CORROSION RESISTANCE COMPOSITE PLATED STEEL STRIP

[75] Inventors: Shigeru Umino; Koji Yamato; Hajime Kimura; Toshio Ichida, all of Chiba, Japan

[73] Assignee: Kawasaki Steel Corporation, Kobe, Japan

[21] Appl. No.: 741,824

[22] Filed: Jun. 6, 1985

[30] Foreign Application Priority Data

Nov. 28, 1984 [JP] Japan ..... 59-250707
May 25, 1985 [JP] Japan ..... 60-112490

[51] Int. Cl.[4] ..... B32B 15/00

[52] U.S. Cl. ..... 428/659; 420/520; 428/935

[58] Field of Search ..... 428/659, 935; 420/520; 204/44.2

[56] References Cited

U.S. PATENT DOCUMENTS 4,048,381 9/1977 Adaniya et al. ..... 428/632
4,401,526 8/1983 Martin ..... 204/44.2

FOREIGN PATENT DOCUMENTS 3221256 3/1983 Fed. Rep. of Germany .
47-16522 5/1972 Japan .
49-19979 5/1974 Japan .
56-517 1/1981 Japan .
58-56039 12/1983 Japan .
2070063 9/1981 United Kingdom .
2120681 12/1983 United Kingdom .

*Primary Examiner*—L. Dewayne Rutledge
*Assistant Examiner*—Robert L. McDowell
*Attorney, Agent, or Firm*—Young & Thompson

[57] ABSTRACT

Composite plated steel strips comprising a zinc base layer electrodeposited on at least one surface of a steel strip exhibit excellent corrosion resistance with or without painting provided that the zinc base layer contains 0.1 to 10% by weight of cobalt, 0.05 to 5% by weight of chromium, 0.05 to 8% by weight of aluminum, and optionally, 0.05 to 5% by weight of Si, the balance being zinc. Such composite plated steel strips are prepared by subjecting a steel strip to composite electroplating in an acidic zinc plating bath which contains at least one water-soluble compound of $Co^{2+}$ in an amount of 0.3 to 60 g/l of metallic cobalt, at least one water-soluble compound of $Cr^{3+}$ in an amount of 0.2 to 2.5 g/l of metallic chromium, a pseudo-boehmite like alumina sol in an amount of 0.5 to 20 g/l of alumina, and optionally, colloidal silica in an amount of 0.5 to 20 g/l of silica of pH 1 or higher and a current density of at least 40 A/dm$^2$.

2 Claims, 7 Drawing Figures

HIGH CORROSION RESISTANCE COMPOSITE PLATED STEEL STRIP

BACKGROUND OF THE INVENTION

This invention relates to composite electroplated steel strips having improved properties such as weldability and corrosion resistance without painting, and post-painting properties including corrosion resistance and paint adherence, and a method for producing the same.

Zinc deposited steel strips are widely employed as rust preventive steel strips in applications requiring corrosion resistance such as automobiles, electric appliances, and building materials. The pure zinc layer deposited on steel has the sacrificial corrosion prevention effect. That is, since zinc is less noble than the iron substrate, the zinc layer is preferentially corroded rather than pinholes and other plating defects and those portions of the iron substrate exposed during certain working process, thus preventing red rust from generating in the steel substrate. Pure zinc, however, forms upon salt water spraying or in a wet environment electro-conductive corrosion products which rapidly grow. The growth of corrosion products of zinc under a paint coating undesirably causes the paint coating to blister and eventually peel off. These drawbacks are due to the activity of pure zinc.

Other attempts to improve the corrosion resistance of Zn platings include alloying or codepositing zinc with a metal more noble in electrical potential than zinc, for example, Co, Ni, Cr, and Fe in order to suppress the activity of Zn platings. A number of patents and publications describe such attempts as will be explained hereinafter.

(1) Japanese Patent Publication No. 47-16522 discloses to add Co, Mo, W and Fe to a Zn plating bath.

(2) Japanese Patent Publication No. 49-19979 discloses to introduce an oxide of Mo, W or Co and/or Ni, Sn, Pb and Fe into a Zn plating layer.

(3) Japanese Patent Publication No. 56-517 discloses to carry out electroplating in a Zn plating bath having Co, $Cr^{3+}$, $Cr^{6+}$, In, and Zr added thereto, thereby producing a Zn plating layer having improved corrosion resistance without painting as well as improving its adaptability to chromate treatment.

(4) Japanese Patent Publication No. 58-56039 discloses to carry out electroplating in an acidic Zn plating bath containing a trivalent chromium salt in an amount of at least 3 g/l of $Cr^{3+}$, thereby obtaining a Zn-Cr deposit having uniform excellent surface tone and luster and improved corrosion resistance.

The plated steel strips obtained by these methods exhibit improved corrosion resistance without painting over pure zinc layers, but has a problem with respect to corrosion resistance after painting. When these plated steel strips are subjected to a phosphate treatment and then to cationic electrophoretic paint deposition, the resulting paint films tend to blister. Besides, method (3) mentioned above carries out electro-plating in a bath containing $Cr^{3+}$ and $Cr^{6+}$ for the purpose of improving the adaptability of zinc plated steel to chromate treatment, and thus improving corrosion resistance after chromate treatment. This method does not improve the corrosion resistance of a plating layer itself or the corrosion resistance thereof with a paint film formed thereon by cationic electrophoretic deposition process subsequent to phosphate treatment.

SUMMARY OF THE INVENTION

It is, therefore, an object of the present invention to provide an improved composite plated steel strip which has eliminated the drawbacks of the prior art techniques and has improved corrosion resistance with or without painting as well as improved workability, paint adherence, and weldability.

It is another object of the present invention to provide an improved method for producing such composite plated steel strips by composite electroplating.

According to a first aspect of the present invention there is provided a high corrosion resistance composite plated steel strip, comprising a zinc base layer electrodeposited on at least one side of a steel strip and comprising 0.1 to 10% by weight of cobalt, 0.05 to 5% by weight of chromium, and 0.05 to 8% by weight of aluminum, the balance being zinc.

According to a second aspect of the present invention, there is provided a high corrosion resistance composite plated steel strip of the same type as above wherein the plating layer further comprises 0.05 to 5% by weight of Si.

A third aspect of the present invention is dircted to a method for preparing a high corrosion resistance composite plated steel strip by subjecting a steel strip to composite electroplating in an acidic zinc plating bath. The bath contains in water at least one water-soluble compound of $Co^{2+}$ in an amount of 0.3 to 60 g/l of metallic cobalt, at least one water-soluble compound of $Cr^{3+}$ in an amount of 0.2 to 2.5 g/l of metallic chromium, and a pseudo-boehmite like alumina sol in an amount of 0.5 to 20 g/l of alumina.

According to a fourth aspect of the present invention, there is provided a high corrosion resistance steel strip preparing method of the same composite plating type as above wherein the bath further contains colloidal silica in an amount of 0.5 to 20 g/l of silica.

Preferably, the electroplating is conducted in the bath at pH of at least 1.0, and most preferably 2 to 3.5 and a current density of at least 40 $A/dm^2$ (amperes per square decimeter), and most preferably at least 60 $A/dm^2$.

BRIEF DESCRIPTION OF THE DRAWINGS

The above and other objects, features, and advantages of the present invention will be more clearly understood from the following description taken in conjunction with the accompanying drawings, in which.

DETAILED DESCRIPTION OF THE INVENTION

Figure 1:
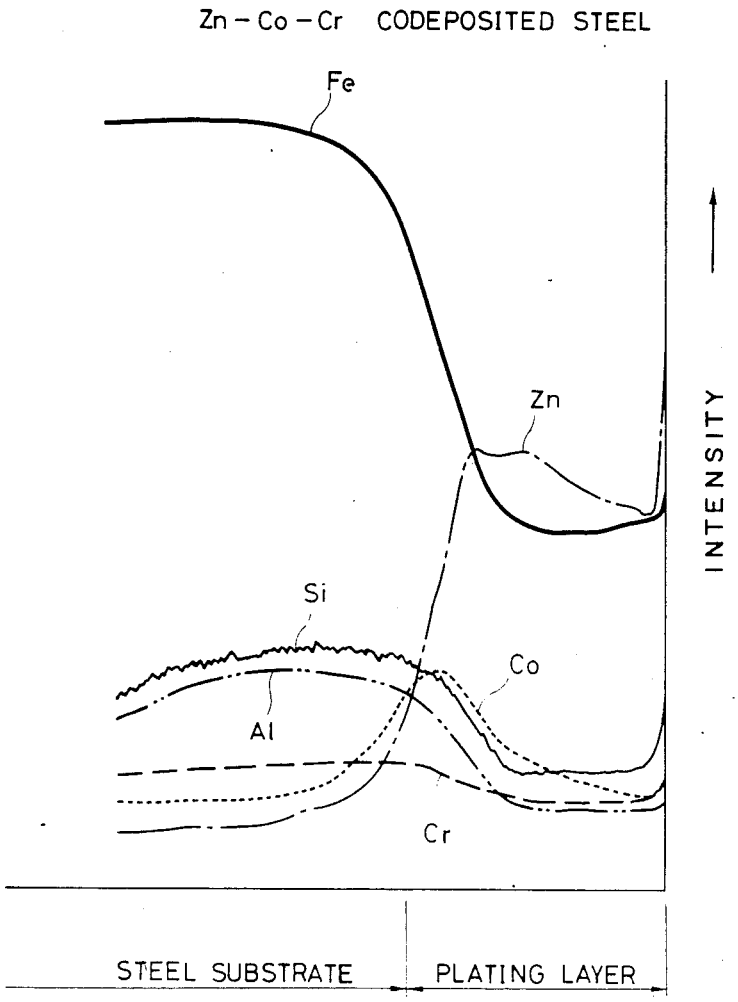
FIG. 1 is a graphical illustration of the analysis of a Zn-Co-Cr plated steel strip by grim glow discharge spectroscopy (G.D.S.) in a depth direction.

The zinc layer electroplated according to the present invention contains Co which contributes to an improvement in corrosion resistance without painting. In the progress of corrosion of Zn and Co in the plating layer, there is formed $Co^{2+}$ which contributes to the formation and stabilization of highly protective corrosion products. The cobalt is found by ESCA (electron spectroscopy for chemical analysis) to be of metallic and oxide forms in the plating layer.

In the composite plated steel strips of the present invention, the cobalt content is limited to 0.1 to 10.0% by weight. Cobalt contents of less than 0.1 wt % are insufficient in improving corrosion resistance without painting whereas the effect of improving the corrosion resistance without painting is saturated beyond the cobalt content of 10.0 wt %. Higher cobalt contents are uneconomic and result in a blackish plating surface with a reduced commercial value. As the alloying cobalt content increases, the plating layer increases its hardness to detract from workability.

The plating layer according to the present invention contains 0.05 to 5% by weight of chromium which is effective in improving the corrosion resistance without painting of the plating layer itself in the co-presence of Co and Al, particularly in an initial corrosion stage. Chromium is also greatly effective in improving the paint receptivity of the plating layer. In the plated steel strips of the present invention, the chromium content is limited to 0.05 to 5% by weight because chromium contents of less than 0.05 wt % are too low to improve corrosion resistance without painting even in the co-presence of Co and Al whereas higher chromium contents beyond 5 wt % do not further improve the effect and somewhat detract from plating adherence.

Aluminum is believed to codeposit in the plating layer in the form of oxide or hydroxide. The codeposited Al effectively accelerates the codeposition of Cr into the plating layer and forms a dense stable corrosion product film with Co and Cr in a corrosive environment, thereby precluding zinc from being dissolved out. In the composite plated steel strips of the present invention, the aluminum content is limited to 0.05 to 8% by weight because aluminum contents of less than 0.05 wt % are too low to improve corrosion resistance whereas higher aluminum contents beyond 8 wt % somewhat detract from plating adherence. The quantitative determination of elemental aluminum is carried out using an electron probe microanalyzer (E.P.M.A.) to quantitatively analyze the total Al quantity on the basis of the working curve because the atomic absorption spectrometry can analyze only an acid soluble portion of the aluminum.

Like aluminum, silicon is also believed to codeposit in the plating layer in the form of oxide or hydroxide. The codeposited Si effectively improves workability because the silicon dispersed throughout the plating layer contributes to lubricity during working. In the composite plated steel strips of the present invention, the silicon content is limited to 0.05 to 5.0% by weight because silicon contents of less than 0.05 wt % are too low to provide improved workability whereas higher silicon contents beyond 5.0 wt % do not add to the workability improvement and adversely affect plating adherence and corrosion resistance.

The composite plated steel strips or sheets of the present invention are prepared by subjecting a steel strip or sheet to composite electroplating in an acidic zinc plating bath. The bath should contain one or more water-soluble compounds of $Co^{2+}$ in an amount of 0.3 to 60 g/l of metallic cobalt, one or more water-soluble compounds of $Cr^{3+}$ in an amount of 0.2 to 2.5 g/l of metallic chromium, and a pseudo-boehmite like alumina sol in an amount of 0.5 to 20 g/l of $Al_2O_3$. The bath may further contain colloidal silica in an amount of 0.5 to 20 g/l of $SiO_2$.

The electroplating may preferably be carried out in the bath at pH 1 or higher and a current density of at least 40 $A/dm^2$, and most preferably at pH 2 to 3.5 and a current density of at least 60 $A/dm^2$.

Examples of the water-soluble compounds of $Co^{2+}$ include cobalt chloride, cobalt sulfate, cobalt nitrate and other known salts soluble in the acidic zinc plating bath. Examples of the water-soluble compounds of $Cr^{3+}$ include chromium chloride, chromium nitrate, chromium sulfate, potassium chromium sulfate, and other known salts. Alumina sol used herein includes dispersions of $Al_2O_3.xH_2O$ (where x has a value from about 1 to about 2) having a particle size of 0.001–0.2 μm in water. The colloidal silica used herein includes dispersions of $SiO_2$ particles having a particle size of 0.001 to 1 μm in water.

Detailed explanation will be given on the respective ingredients added to the zinc electroplating bath in the practice of the method of the present invention. (1) Divalent cobalt ion $Co^{2+}$ is codeposited with zinc during plating to render the plating layer passivated to suppress dissolution of the plating layer, improving corrosion resistance without painting or of the plating layer itself. The cobalt compound is added to the bath in an amount of 0.3 to 60 g/l of metallic Co. Amounts less than 0.3 g/l result in insufficient quantities of Co codeposited in the plating layers to provide corrosion resistance. Amounts beyond 60 g/l undesirably result in a blackish surface and a less adherent plating, and are uneconomic. (2) Trivalent chromium ion $Cr^{3+}$ is codeposited in the plating layer as chromium oxide and/or hydroxide which cooperates with cobalt and aluminum oxide (probably, AlOOH) to improve the corrosion resistance of the plating layer without painting and to improve the adhesion of paint thereto.

The amount of the $Cr^{3+}$ compound added to the plating bath is limited to 0.2 to 2.5 g/l of metallic chromium while the amount of alumina sol should be at least 0.5 g/l of $Al_2O_3$. Amounts of the chromium compound of less than 0.2 g/l of Cr are insufficient to improve paint film adherence and corrosion resistance whereas extra amounts beyond 2.5 g/l of Cr undesirably reduce plating adherence and cause green color oxides to deposit on the plating surface with an unaesthetic appearance. (3) The pseudo-boehmite like alumina sol added to the plating bath in the practice of the present invention is codeposited in the plating layer as aluminum oxide and/or aluminum hydroxide or. The alumina sol should preferably be pseudo-boehmite like alumina sol in the form of $Al_2O_3.xH_2O$ where x is about 1.5 and having a particle size of 5 to 30 nm. Amorphous alumina sol generally having a particle size of 100 to 200 nm is undesirable because of the hindered codeposition of Al in the plating layer and viscosity increase. The addition of pseudo-boehmite like alumina sol permits chromium, which is otherwise difficult to codeposit uniformly in a substantial quantity, to codeposit with aluminum oxide uniformly in a substantial quantity. This is because trivalent chromium cation is adsorbed on negatively charged alumina particles so that they may simultaneously codeposit.

Figure 2:
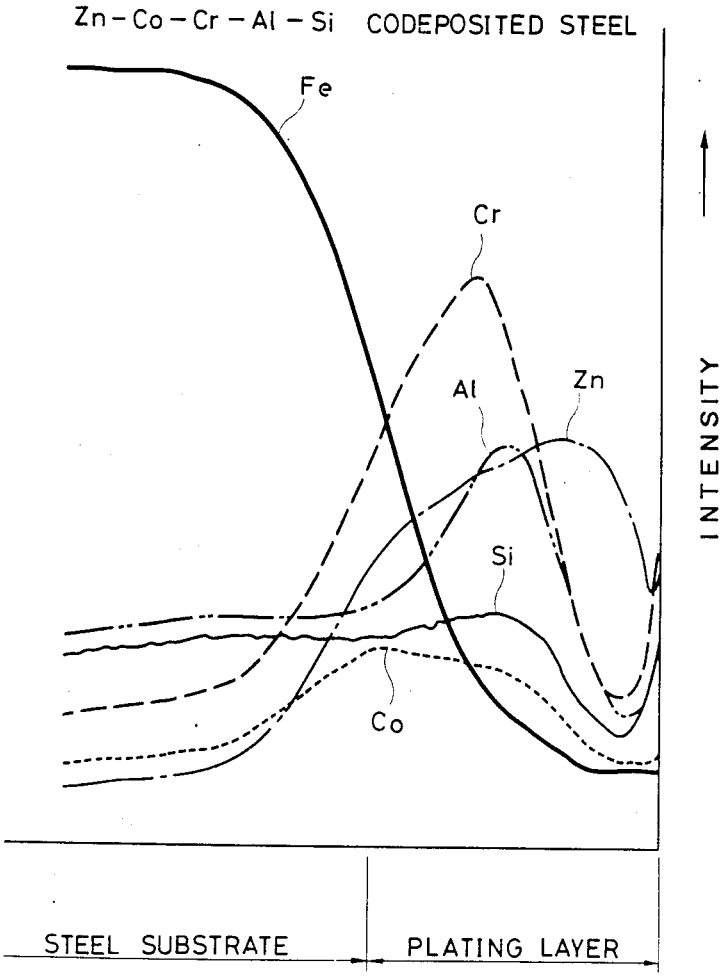
FIG. 2 is a graphical illustration of the analysis of Zn-Co-Cr-Al-Si plated steel strips by G.D.S. in a depth direction.

FIG. 1 is a graph showing the results of analysis of a Zn-Co-Cr plated steel strip by grim glow discharge spectroscopy (G.D.S.) in a depth direction. As seen from FIG. 1, little chromium is codeposited in the plating layer. FIG. 2 is a graph showing the results of analysis of a Zn-Co-Cr-Al-Si plated steel strip by the G.D.S. in a depth direction, the strip being plated in a bath similaur to that used for the strip in FIG. 1, but containing pseudo-boehmite like alumina sol and colloidal silica. As seen from FIG. 2, Cr, Al, and Si are codeposited in the plating layer.

Figure 3:
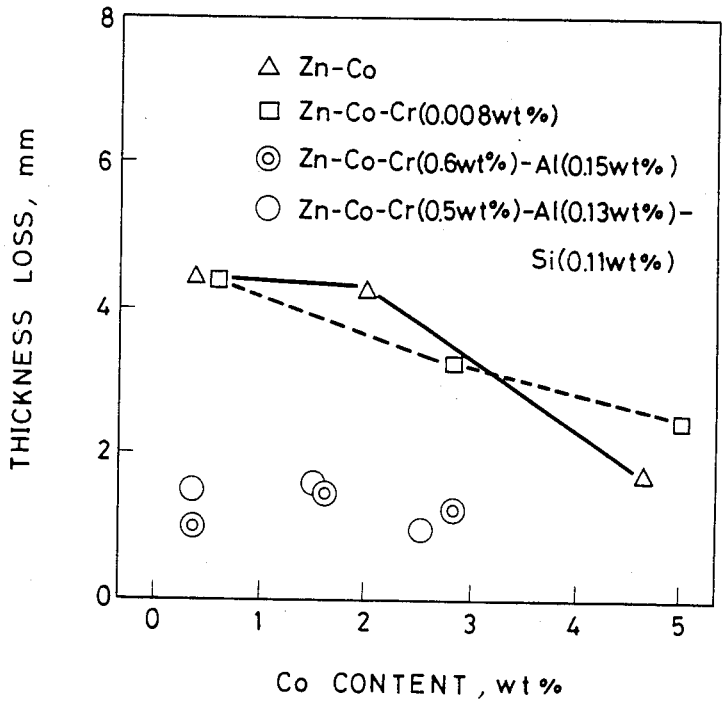
FIG. 3 is a graphical illustration of the corrosion resistance without painting of various plating layers in a salt spray test according to JIS Z 2371 for 30 days.

The deposited Cr and Al oxide cooperate with Co to further improve the corrosion resistance without painting as seen from FIG. 3 and to form and sustain a stable corrosion product (zinc hydroxide) on the plating surface.

Figure 4:
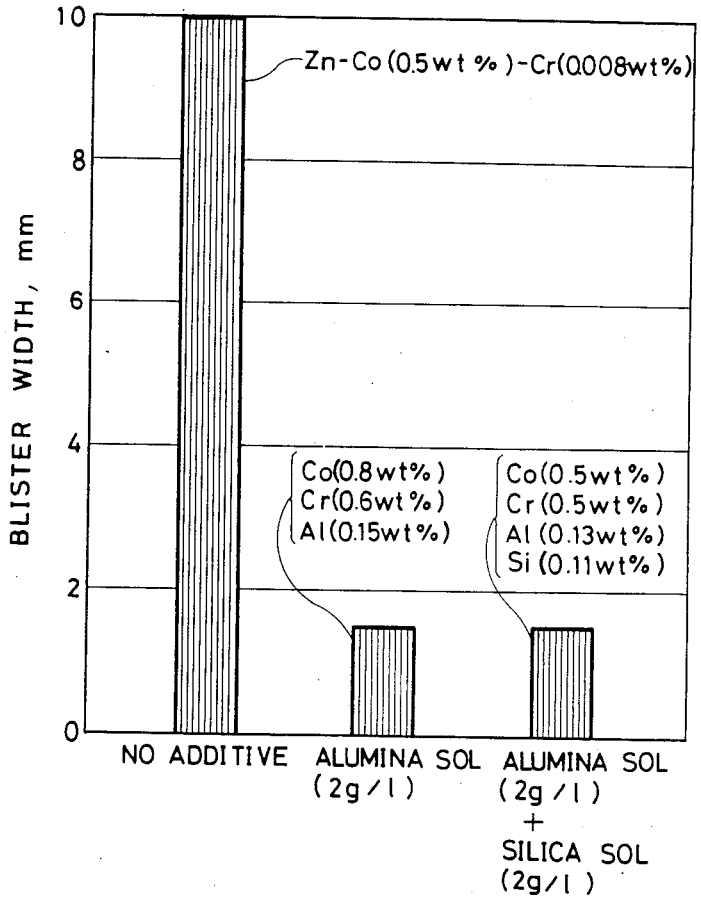
FIG. 4 is a diagram showing the width of blister at cross-cuts in a 20-μm thick paint film applied by cationic electrophoretic paint deposition.

With respect to the corrosion resistance after phosphate treatment followed by cationic electrophoretic paint deposition, as shown in FIG. 4, the addtion of alumina sol results in an outstanding improvement over the Zn-Co-Cr plating layer. Although the reason is not clearly understood, it is believed that a combination of adequate sacrificial corrosion prevention and good paint film adherence is effective in preventing the blister of the paint film and the dissolving of the steel substrate.

Figure 5:
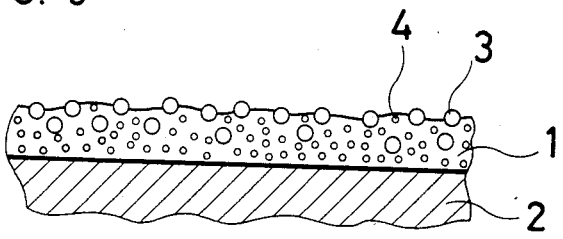
FIG. 5 schematically illustrates in cross section a steel strip having a Zn-Co-Cr-Al-Si plating layer.

The amount of alumina sol added is limited to 0.5 to 20 g/l of $Al_2O_3$ because amounts of less than 0.5 g/l will result in insufficient quantities of Cr and Al being codeposited in the plating layer, failing to improve corrosion resistance and paint film adherence to a substantial extent. The plating solution containing more than 20 g/l of $Al_2O_3$ is too viscous to effectively carry out electroplating. (4) The silica sol added to the plating bath in the practice of the present invention is codeposited in a plating surface layer as $SiO_2$. The codeposition of silica in a surface layer results in improved workability and spot weldability. FIG. 5 schematically illustrates in cross section the Zn-Co-Cr-Al-Si plating layer. A Zn-Co-Cr-Al-Si plating layer 1 is formed on a steel substrate 2. Silica particles 3 and aluminum oxide particles 4 are codeposited in the plating layer 1. It is shown that silica particles 3 are present in a surface region of the plating layer and some of them are exposed on the surface. During working, the exposed silica particles come in contact with the die to provide a reduced coefficient of friction accompanied by improved workability. Further, the presence of aluminum oxide and silica ($SiO_2$) in a surface region of the plating layer results in an increased insulation resistance so that the optimum welding current range is shifted to a lower side, which means that more heat can be generated with a lower welding current.

More particularly, the optimum welding current range is between 6.5 and 13 kiloamperes for Zn-Co-Cr systems, between 6 and 12.5 kiloamperes for Zn-Co-Cr-Al systems, and between 5 and 12 kiloamperes for Zn-Co-Cr-Al-Si systems. As it becomes possible to carry out spot welding at low current, electrode tips can be struck more times or at more spot welds without replacement in continuous spot welding.

In the practice of the present method, zinc electroplating may be carried out in any acid baths including chloride and sulfate baths.

Figure 6:
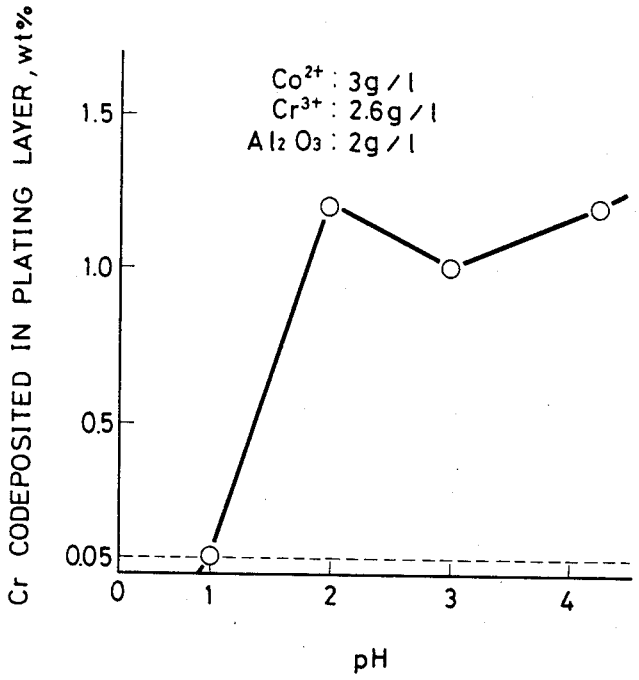
FIG. 6 is a graphical illustration of the quantity of Cr codeposited in the plating layer as a function of the pH of a plating solution which contains 200 g/l of $ZnCl_2$, 350 g/l of KCl, 12 g/l of $CoCl_2.6H_2O$, 13.5 g/l of $CrCl_2.6H_2O$, and 2 g/l of alumina sol and is operated at a temperature of 50° C. and a current density of 150 $A/dm^2$.

The zinc plating bath having the above-described composition may preferably be set to pH 1.0 or higher, and more preferably pH 2 to 3.5. It is difficult to codeposit Cr in the plating layer when the plating bath is at a pH value of lower than 1.0, as seen from FIG. 6. Plating baths having higher pH beyond 3.5 tend to yield chromium oxide and show unstable performance in a continuous plating line. Because of these disadvantages, the upper limit of 3.5 is preferably imposed on the pH of the plating bath.

The current density used in the practice of the present method may preferably be at least 40 A/dm$^2$, and more preferably at least 60 A/dm$^2$. Current densities of lower than 40 A/dm$^2$ will result in plating layers having a blackish grey appearance and deteriorated adherence.

EXAMPLES

Examples of the present invention are presented below along with comparative examples by way of illustration and not by way of limitation.

A cold rolled steel sheet (SPCC) was electrolytically degreased with alkaline solution, pickled with 5% aqueous hydrochloric acid, rinsed with water, and then electroplated under the following conditions. The plating bath was agitated by means of a pump and passed at a flow rate of about 60 m/min. at a temperature of 50° C. The anode used was a pure zinc plate and spaced a distance of 10 mm from the cathode or the steel strip. The weight of a plating layer deposited was set to 20 g/m$^2$.

The aluminum and silicon sources added to the plating bath are Alumina Sol #520 and Snowtex-O which are both water dispersable colloidal sols and manufactured and sold by Nissan Chemical K.K., Japan.

The plating baths used in examples and comparative exmples had the following parameters.

EXAMPLES 1–9

Chloride bath

| | |
|---|---|
| $ZnCl_2$ | 200 g/l |
| KCl | 350 g/l |
| $CoCl_2.6H_2O$ | 0.3–5.9 g/l of metallic Co |
| $CrCl_3.6H_2O$ | 0.2–2.5 g/l of metallic Cr |
| Alumina sol (pseudo-boehmite, particle size about 15 nm, no thixotropy) | 0.5–20 g/l of $Al_2O_3$ |
| pH | 3 |
| Temperature | 50° C. |
| Current density | 100 A/dm$^2$ |

EXAMPLES 10–17

Chloride bath

| | |
|---|---|
| $ZnCl_2$ | 200 g/l |
| KCl | 350 g/l |
| $CoCl_2.6H_2O$ | 0.3–5.9 g/l of metallic Co |
| $CrCl_3.6H_2O$ | 0.2–2.5 g/l of metallic Cr |
| Alumina sol (pseudo-boehmite, particle size about 15 nm) | 2 g/l of $Al_2O_3$ |
| Silica sol (particle size 12–15 nm) | 0.5–20 g/l of $SiO_2$ |
| pH | 3 |

-continued

| | |
|---|---|
| Temperature | 50° C. |
| Current density | 100 A/dm$^2$ |

EXAMPLES 18–21

Sulfate bath

| | |
|---|---|
| $ZnSO_4$ | 350 g/l |
| $Na_2SO_4$ | 40 g/l |
| $CoSO_4.7H_2O$ | 1.2–59.2 g/l of metallic Co |
| $CrCl_3.6H_2O$ | 2.5 g/l of metallic Cr |
| Alumina sol (pseudo-boehmite, particle size about 15 nm) | 0.5–20 g/l of $Al_2O_3$ |
| pH | 3 |
| Temperature | 50° C. |
| Current density | 80 A/dm$^2$ |

EXAMPLES 22–30

Sulfate bath

| | |
|---|---|
| $ZnSO_4$ | 250 g/l |
| $CoSO_4.7H_2O$ | 1.2–59.2 g/l of metallic Co |
| $K_2Cr_2(SO_4)_4.24H_2O$ | 1.0–2.5 g/l of metallic Cr |
| Alumina sol (pseudo-boehmite, particle size about 15 nm) | 2 g/l of $Al_2O_3$ |
| Silica sol (particle size 12–15 nm) | 0.5–20 g/l of $SiO_2$ |
| pH | 3.5 |
| Temperature | 50° C. |
| Current density | 80 A/dm$^2$ |

COMPARATIVE EXAMPLES 1–2

Chloride bath

The bath had the same parameters as in Examples 1–9 except that an amorphous alumina sol having a particle size of about 100 nm was added in an amount of 2 g/l of $Al_2O_3$.

COMPARATIVE EXAMPLES 3–5

Chloride bath

| | |
|---|---|
| $CoCl_2.6H_2O$ | 0.2 g/l of metallic Co |
| $CrCl_3.6H_2O$ | 0.1–2.6 g/l of metallic Cr |
| Alumina sol (pseudo-boehmite, particle size about 15 nm) | 2 g/l of $Al_2O_3$ |

The amounts of $ZnCl_2$ and KCl and the plating parameters are the same as in Examples 1–9.

COMPARATIVE EXAMPLES 6–7

Chloride bath

The bath had the same composition as in Examples 1–9, but the plating parameters were changed to pH 3, bath temperature 50° C., and current density 30 A/dm$^2$.

COMPARATIVE EXAMPLES 8–10

Sulfate bath

| | |
|---|---|
| $CoSO_4.7H_2O$ | 10.5 and 70 g/l of metallic Co |
| $K_2Cr_2(SO_4)_4.24H_2O$ | 1.0 and 2.6 g/l of metallic Cr |
| Alumina sol (pseudo-boehmite, particle size about 15 nm) | 0.1 and 30 g/l of $Al_2O_3$ |

The amounts of $ZnSO_4$ and $Na_2SO_4$ and the plating parameters were the same as in Examples 18–21.

COMPARATIVE EXAMPLES 11–14

Sulfate bath

| | |
|---|---|
| $CoSO_47H_2O$ | 10.5 and 70 g/l of metallic Co |
| $K_2Cr_2(SO_4)_4.24H_2O$ | 1.0 and 2.6 g/l of metallic Cr |
| Alumina sol (pseudo-boehmite, particle size about 15 nm) | 2 g/l of $Al_2O_3$ |
| Silica sol (particle size 12–15 nm) | 0.5 and 30 g/l of $SiO_2$ |

The amounts of $ZnSO_4$ and $Na_2SO_4$ and the plating parameters were the same as in Examples 18–21.

The composite plated steel strip samples obtained in the foregoing Examples and Comparative Examples were subject to the following tests. The results are shown in Table 1 for Examples and Table 2 for Comparative Examples.

Quantitative determination of the respective elements was performed by atomic absorption spectroscopy for Co and Cr, absorption spectrometry using molybdenum blue for Si, and E.P.M.A. for Al.

(1) Evaluation of plating layer adherence

Each sample was subjected to the Dupont impact test using a falling weight having a diameter of ¼ inches and weighing 1 kg from a height of 50 cm, and evaluated whether the plating layer was separated. Symbols used for evaluation have the following meanings.

Figure 7:
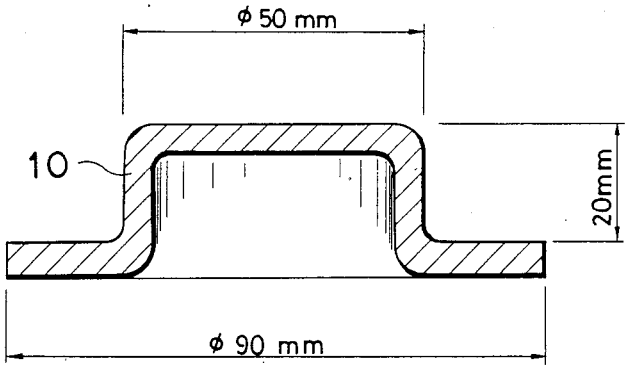
FIG. 7 is a cross-sectional view of a plated steel strip drawn into a cup shape as used in a workability evaluation test.

◎ : no separation
O: little separation
Δ: slight separation
X: separation (2) Evaluation of workability Each plated steel sample designated at 10 was drawn into a cup shape as shown in FIG. 7. An adhesive tape was applied to and removed from the drawn portion and a weight loss was measured for evaluation. Symbols used for evaluation have the following meanings.

◎ : 0–2 mg
O: 2–5 mg
Δ: more than 5 mg
X: could not be drawn (3) Evaluation of corrosion resistance Corrosion resistances with and without painting were comprehensively evaluated.

(3-1) Corrosion resistance without painting

Each plated steel sample was subjected to a salt spray test according to JIS Z 2371 and measured for thickness reduction after 720 hours.

(3-2) Corrosion resistance after painting

Each plated steel sample was further subjected to phosphate treatment with Bonderite #3030 (manufactured and sold by Nihon Parkerizing K.K.) and then to cationic electrophoretic paint deposition using Power Top U-30 Grey (manufactured and sold by Nihon Paint K.K.) to a thickness of 20 μm. Crosscuts were formed in the paint film to reach the underlying steel before the sample was subjected to a salt spray test according to JIS Z 2371 for 340 hours. At the end of the salt spray test, the width of blisters on the sample was measured.

Symbols used for evaluation have the following meanings.

Thickness loss (corrosion resistance without painting)

◎ : less than 0.2 mm
O: 0.2–0.4 mm
Δ: 0.4–0.6 mm
X: more than 0.6 mm

Blister width (corrosion resistance after painting)

◎ : 0–2 mm
O: 2–4 mm
Δ: 4–6 mm
X: more than 6 mm

It should be noted that the "Al" content in the plating layer in the Tables is total aluminum as described above.

The composite plated steel strips according to the present invention have the improved corrosion resistance of the plating layer itself, that is, without painting, and improved corrosion resistance after painting as well as exhibiting improved workability, paint adherence, and weldability.

Such composite plated steel strips can be readily oroduced simply by using a plating bath having a specific composition.

What is claimed is:

1. A high corrosion resistance composite plated steel strip, comprising

TABLE 1

Examples

| No. | Bath composition, g/l | | | | Planting layer composition, wt % | | | | Plating adherence | Work-ability | Corrosion resistance without painting | Corrosion resistance after painting |
|---|---|---|---|---|---|---|---|---|---|---|---|---|
| | Co | Cr | Alumina | Silica | Co | Cr | Al | Si | | | | |
| 1 | 0.3 | 0.2 | 0.5 | — | 0.2 | 0.05 | 0.05 | — | ◎ | ◎ | O | O |
| 2 | 0.6 | 0.5 | 2 | — | 0.8 | 0.6 | 0.15 | — | ◎ | ◎ | ◎ | ◎ |
| 3 | 5.9 | 0.2 | 0.5 | — | 9.6 | 0.08 | 0.06 | — | O | O | ◎ | O |
| 4 | 0.3 | 2.5 | 0.5 | — | 0.3 | 0.6 | 0.09 | — | ◎ | ◎ | O | ◎ |
| 5 | 0.3 | 0.2 | 20 | — | 0.2 | 0.10 | 7.9 | — | O | ◎ | ◎ | ◎ |
| 6 | 5.9 | 2.5 | 0.5 | — | 8.8 | 0.6 | 0.08 | — | O | ◎ | ◎ | ◎ |
| 7 | 5.9 | 2.5 | 20 | — | 8.1 | 4.5 | 7.1 | — | O | O | ◎ | ◎ |
| 8 | 0.3 | 2.5 | 20 | — | 0.2 | 4.2 | 7.7 | — | O | ◎ | O | ◎ |
| 9 | 5.8 | 0.2 | 20 | — | 7.8 | 0.11 | 6.3 | — | O | O | ◎ | ◎ |
| 10 | 0.3 | 0.2 | 2 | 0.5 | 0.1 | 0.05 | 0.1 | 0.05 | ◎ | ◎ | O | O |
| 11 | 0.6 | 0.5 | 2 | 2 | 0.5 | 0.5 | 0.13 | 0.11 | ◎ | ◎ | ◎ | ◎ |
| 12 | 5.9 | 0.2 | 2 | 0.5 | 9.2 | 0.08 | 0.10 | 0.06 | O | ◎ | ◎ | O |
| 13 | 0.3 | 2.5 | 2 | 0.5 | 0.2 | 2.0 | 0.13 | 0.05 | ◎ | ◎ | ◎ | ◎ |
| 14 | 0.3 | 0.2 | 2 | 20 | 0.1 | 0.06 | 0.09 | 4.1 | ◎ | ◎ | O | O |
| 15 | 5.7 | 2.3 | 2 | 0.5 | 8.4 | 1.8 | 0.12 | 0.06 | O | ◎ | ◎ | ◎ |
| 16 | 5.3 | 0.3 | 2 | 15 | 7.2 | 0.08 | 0.11 | 3.1 | O | ◎ | ◎ | O |
| 17 | 0.3 | 2.5 | 2 | 18 | 0.11 | 2.0 | 0.10 | 3.5 | ◎ | ◎ | O | O |
| 18 | 1.2 | 2.5 | 0.5 | — | 0.12 | 0.4 | 0.07 | — | ◎ | ◎ | O | ◎ |
| 19 | 59.2 | 2.5 | 20 | — | 7.8 | 3.0 | 6.8 | — | O | O | ◎ | ◎ |
| 20 | 1.2 | 2.5 | 20 | — | 0.10 | 2.5 | 6.1 | — | O | ◎ | O | ◎ |
| 21 | 59.2 | 2.5 | 0.5 | — | 7.2 | 0.5 | 0.05 | — | O | O | ◎ | ◎ |
| 22 | 1.2 | 1.0 | 2 | 0.5 | 0.11 | 0.8 | 0.10 | 0.05 | ◎ | ◎ | ◎ | ◎ |
| 23 | 59.2 | 1.0 | 2 | 0.5 | 7.6 | 0.9 | 0.11 | 0.05 | O | ◎ | ◎ | ◎ |
| 24 | 1.2 | 2.5 | 2 | 0.5 | 0.13 | 2.3 | 0.13 | 0.06 | ◎ | ◎ | O | ◎ |
| 25 | 1.2 | 1.0 | 2 | 20 | 0.12 | 0.8 | 0.12 | 4.2 | O | ◎ | ◎ | O |
| 26 | 59.2 | 2.5 | 2 | 0.5 | 7.5 | 2.2 | 0.09 | 0.06 | O | ◎ | ◎ | ◎ |
| 27 | 59.2 | 2.5 | 2 | 20 | 7.9 | 2.1 | 0.10 | 4.1 | O | ◎ | ◎ | ◎ |
| 28 | 59.2 | 1.0 | 2 | 20 | 7.2 | 0.9 | 0.08 | 3.8 | O | ◎ | ◎ | O |
| 29 | 1.2 | 2.5 | 2 | 20 | 0.11 | 2.4 | 0.11 | 3.6 | O | ◎ | O | O |
| 30 | 10.5 | 2.5 | 2 | 2 | 1.1 | 2.3 | 0.12 | 0.09 | O | ◎ | ◎ | ◎ |

a steel strip, and

TABLE 2

Comparative Examples

| No. | Bath composition, g/l | | | | Planting layer Composition, wt % | | | | Plating adherence | Work-ability | Corrosion resistance without painting | Corrosion resistance after painting |
|---|---|---|---|---|---|---|---|---|---|---|---|---|
| | Co | Cr | Alumina | Silica | Co | Cr | Al | Si | | | | |
| 1 | 0.6 | 0.5 | 2*1 | — | 1.0 | 0.01 | 0.03 | — | ◎ | Δ | Δ | Δ |
| 2 | 5.8 | 0.5 | 2*1 | — | 9.5 | 0.02 | 0.04 | — | Δ | Δ | ◎ | O |
| 3 | 0.2 | 0.1 | 2 | — | 0.08 | 0.04 | 0.12 | — | O | O | Δ | X |
| 4 | 0.2 | 2.6 | 2 | — | 0.09 | 2.2 | 0.17 | — | O | O | Δ | Δ |
| 5 | 0.2 | 0.5 | 2 | — | 0.08 | 0.4 | 0.15 | — | O | Δ | Δ | Δ |
| 6*2 | 0.6 | 0.5 | 2 | — | 0.9 | 0.7 | 0.18 | — | X | Δ | O | O |
| 7*2 | 0.6 | 0.5 | 20 | — | 0.7 | 0.6 | 8.1 | — | X | Δ | O | O |
| 8 | 10.5 | 1.0 | 0.1 | — | 1.3 | 0.03 | 0.01 | — | O | Δ | Δ | Δ |
| 9 | 70 | 1.0 | 0.1 | — | 10.3 | 0.02 | 0.01 | — | X | X | ◎ | O |
| 10 | 10.5 | 2.6 | 30 | — | 1.1 | 2.8 | 8.3 | — | X | Δ | O | O |
| 11 | 10.5 | 1.0 | 2 | 30 | 1.1 | 0.7 | 0.11 | 5.1 | X | O | O | Δ |
| 12 | 70 | 1.0 | 2 | 0.5 | 11.0 | 0.8 | 0.12 | 0.04 | X | Δ | ◎ | Δ |
| 13 | 70 | 1.0 | 2 | 30 | 11.2 | 0.5 | 0.13 | 5.2 | X | O | ◎ | Δ |
| 14 | 70 | 2.6 | 2 | 30 | 11.3 | 2.2 | 0.11 | 5.3 | X | O | ◎ | Δ |

*1amorphous alumina sol having a particle size of about 100 nm
*2plating at a current density of 30 $A/dm^2$ a zinc base layer electrodeposited on at least one side of said steel strip and consisting essentially of 0.1 to 10% by weight of cobalt, 0.05 to 5% by weight of chromium, and 0.05 to 8% by weight of aluminum in the form of particulate aluminum oxide or hydroxide, balance essentially zinc.

2. A high corrosion resistance composite plated steel strip, comprising a steel strip, and a zinc base layer electrodeposited on at least one side of said steel strip and consisting essentially of 0.1 to 10% by weight of cobalt, 0.05 to 5% by weight of chromium, 0.05 to 8% by weight of aluminum, and 0.05 to 5% by weight of Si, balance essentially zinc.

* * * * *